US012137787B2

(12) United States Patent
Lee et al.

(10) Patent No.: US 12,137,787 B2
(45) Date of Patent: Nov. 12, 2024

(54) COSMETIC CONTAINER IN WHICH APPLICATION MEANS HAVING AIR STORAGE SPACE IS EMBEDDED

(71) Applicant: TMBM CO., LTD., Seoul (KR)

(72) Inventors: Dae Kyu Lee, Seoul (KR); Joo Hee Hyeon, Seoul (KR)

(73) Assignee: TMBM CO., LTD., Seoul (KR)

( * ) Notice: Subject to any disclaimer, the term of this patent is extended or adjusted under 35 U.S.C. 154(b) by 327 days.

(21) Appl. No.: 17/596,739

(22) PCT Filed: Jun. 12, 2020

(86) PCT No.: PCT/KR2020/007668
§ 371 (c)(1),
(2) Date: Dec. 16, 2021

(87) PCT Pub. No.: WO2020/256356
PCT Pub. Date: Dec. 24, 2020

(65) Prior Publication Data

US 2022/0312931 A1 Oct. 6, 2022

(30) Foreign Application Priority Data

Jun. 17, 2019 (KR) ..... 10-2019-0071566
Mar. 6, 2020 (KR) ..... 10-2020-0028122
May 29, 2020 (KR) ..... 10-2020-0065174

(51) Int. Cl.
*A45D 33/00* (2006.01)

(52) U.S. Cl.
CPC ..... *A45D 33/006* (2013.01)

(58) Field of Classification Search
CPC .. A45D 33/003; A45D 33/006; A45D 33/008; A45D 33/20; A45D 33/22;
(Continued)

(56) References Cited

U.S. PATENT DOCUMENTS

2008/0011320 A1* 1/2008 Bouix ..... A45D 33/006 132/293
2009/0057326 A1* 3/2009 Opitz ..... B65D 51/20 206/524.1
(Continued)

FOREIGN PATENT DOCUMENTS

JP 3130046 U 3/2007
JP 2015-205131 A 11/2015
(Continued)

OTHER PUBLICATIONS

WO2018117503 A1. Translation (Year: 2018).*
International Search Report and Written Opinion issued in application No. PCT/KR2020/007668, mailed Oct. 13, 2020.

*Primary Examiner* — Cris L. Rodriguez
*Assistant Examiner* — Karim Asqiriba
(74) *Attorney, Agent, or Firm* — Knobbe, Martens, Olson & Bear, LLP

(57) ABSTRACT

This application relates to a cosmetic container. In one aspect, the cosmetic container includes a container including a containing portion for containing contents of cosmetic products, and a lid functioning not only as a lid for the containing portion but also as a house for an application member, which includes an application member accommodating portion where an application member is accommodated, and a blocked bottom plate. A plurality of protrusions protruding upwards are provided at the application member accommodating portion of the lid. The application member is placed to be in contact with an upper surface of the protrusions in the application member accommodating portion. A first air storage portion is formed between the application member and a bottom surface of the lid.

8 Claims, 11 Drawing Sheets

(58) Field of Classification Search
CPC ..... A45D 33/24; A45D 33/025; A45D 33/26; A45D 40/00; A45D 40/24; A45D 42/02
See application file for complete search history.

(56) References Cited

U.S. PATENT DOCUMENTS

| | | | | |
|---|---|---|---|---|
| 2009/0188518 | A1* | 7/2009 | Thorpe | A45D 33/16 132/307 |
| 2009/0272399 | A1* | 11/2009 | Kim | A45D 33/008 132/293 |
| 2011/0048443 | A1* | 3/2011 | Pires | A45D 33/003 132/200 |
| 2020/0023393 | A1* | 1/2020 | Kang | B05B 11/1073 |

FOREIGN PATENT DOCUMENTS

| | | | | |
|---|---|---|---|---|
| KR | 20-2000-0010873 | | 6/2000 | |
| KR | 10-1385339 | | 4/2014 | |
| KR | 10-1697242 | B1 | 2/2017 | |
| KR | 10-2018-0077646 | A | 7/2018 | |
| WO | WO-2018117503 | A1 * | 6/2018 | A45D 33/36 |

* cited by examiner

【FIG. 1】
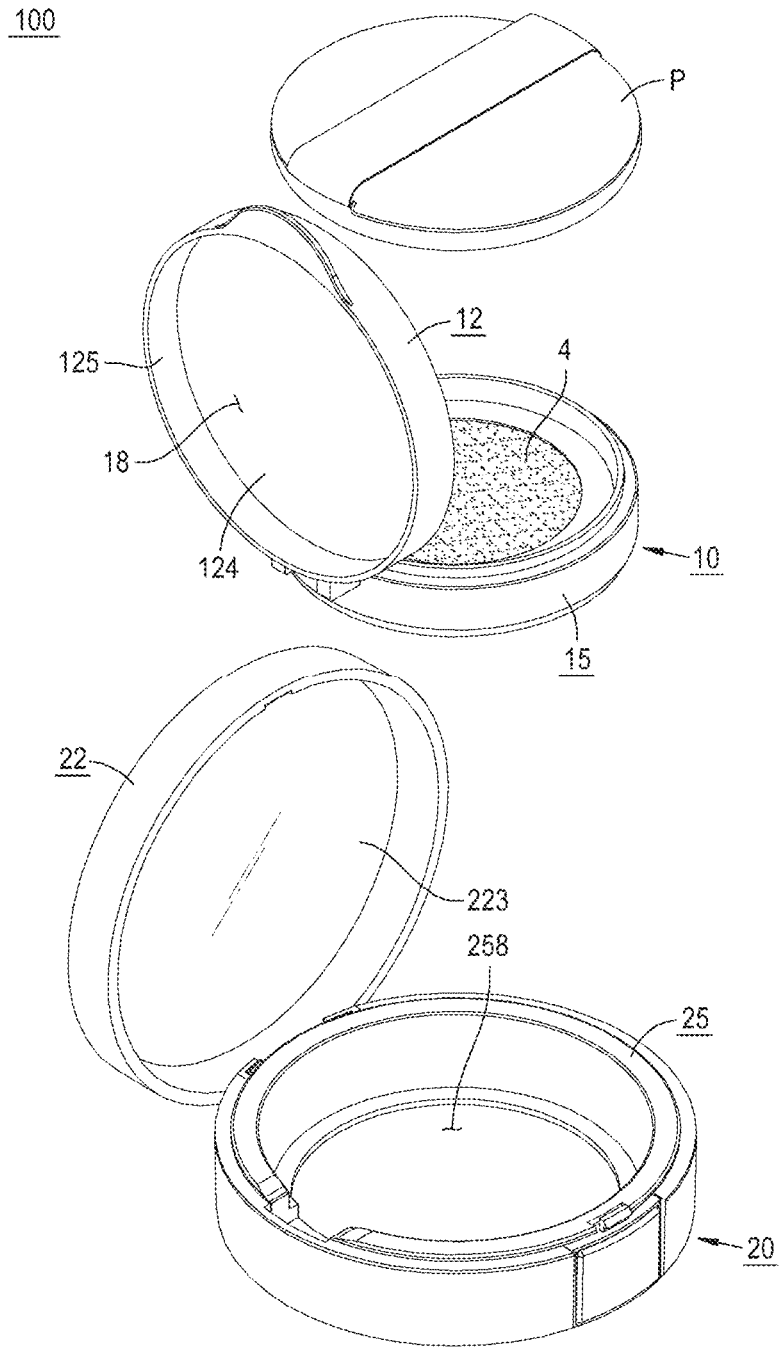
PRIOR ART

【FIG. 2】
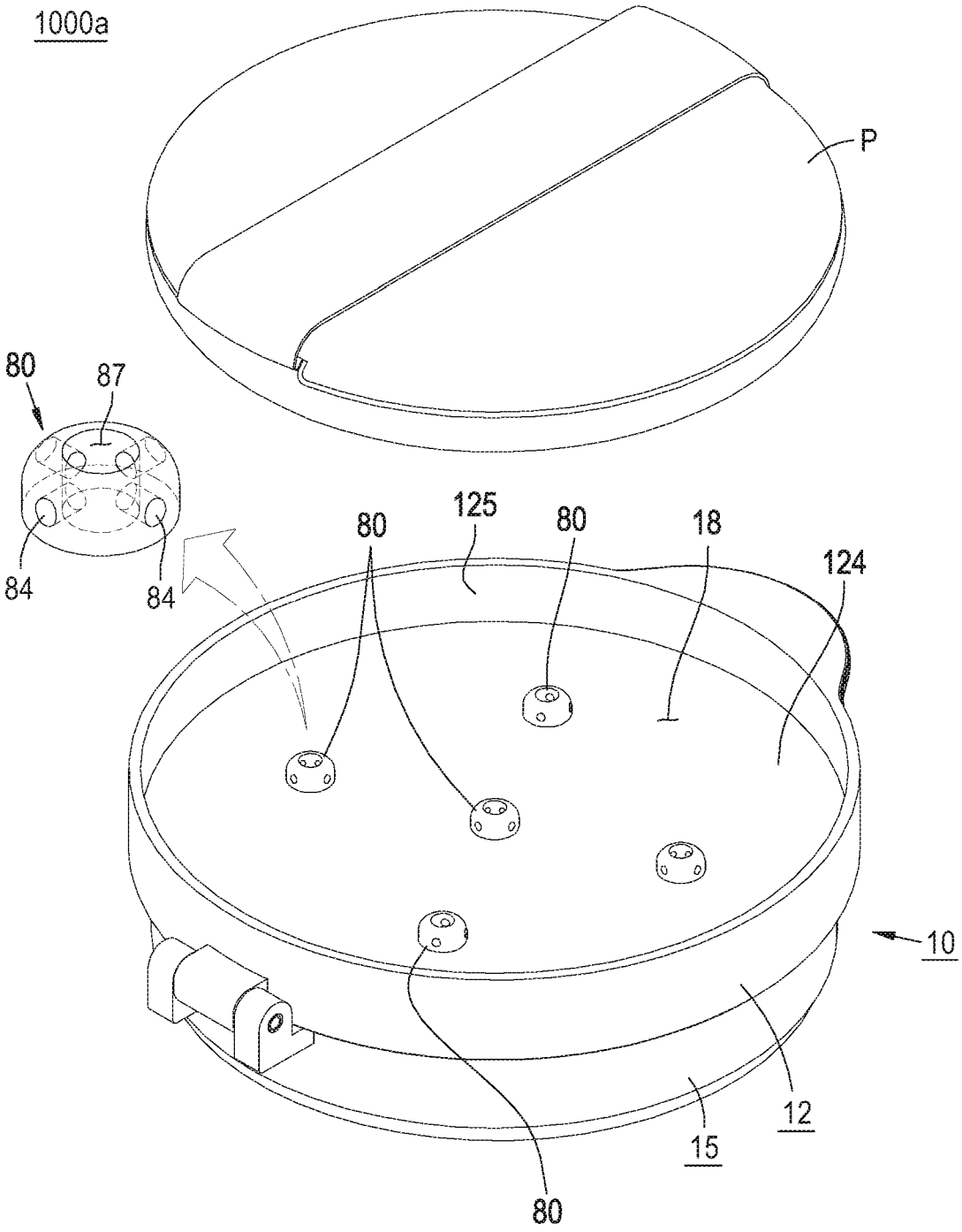

【FIG. 3】
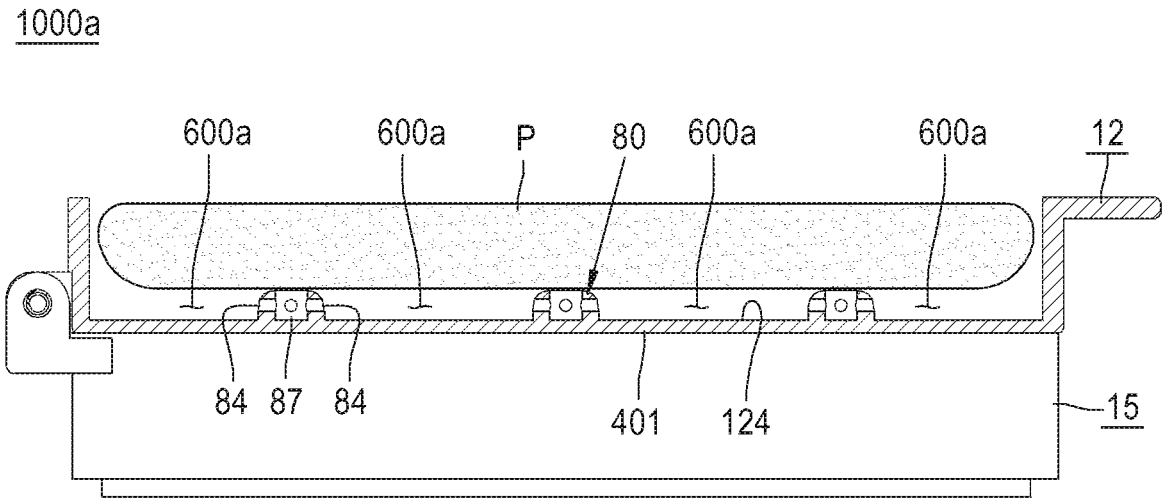

【FIG. 4】
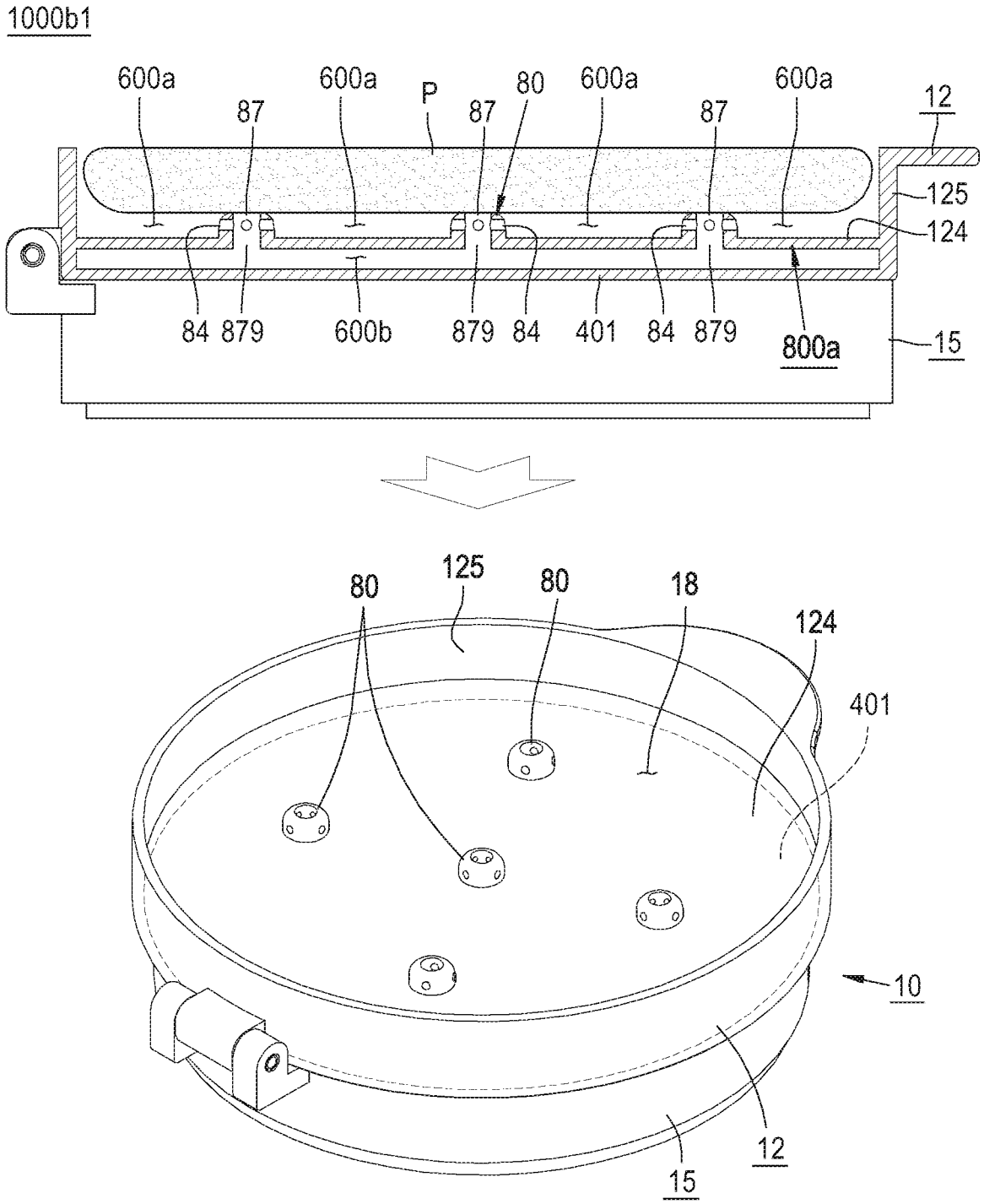

【FIG. 5】
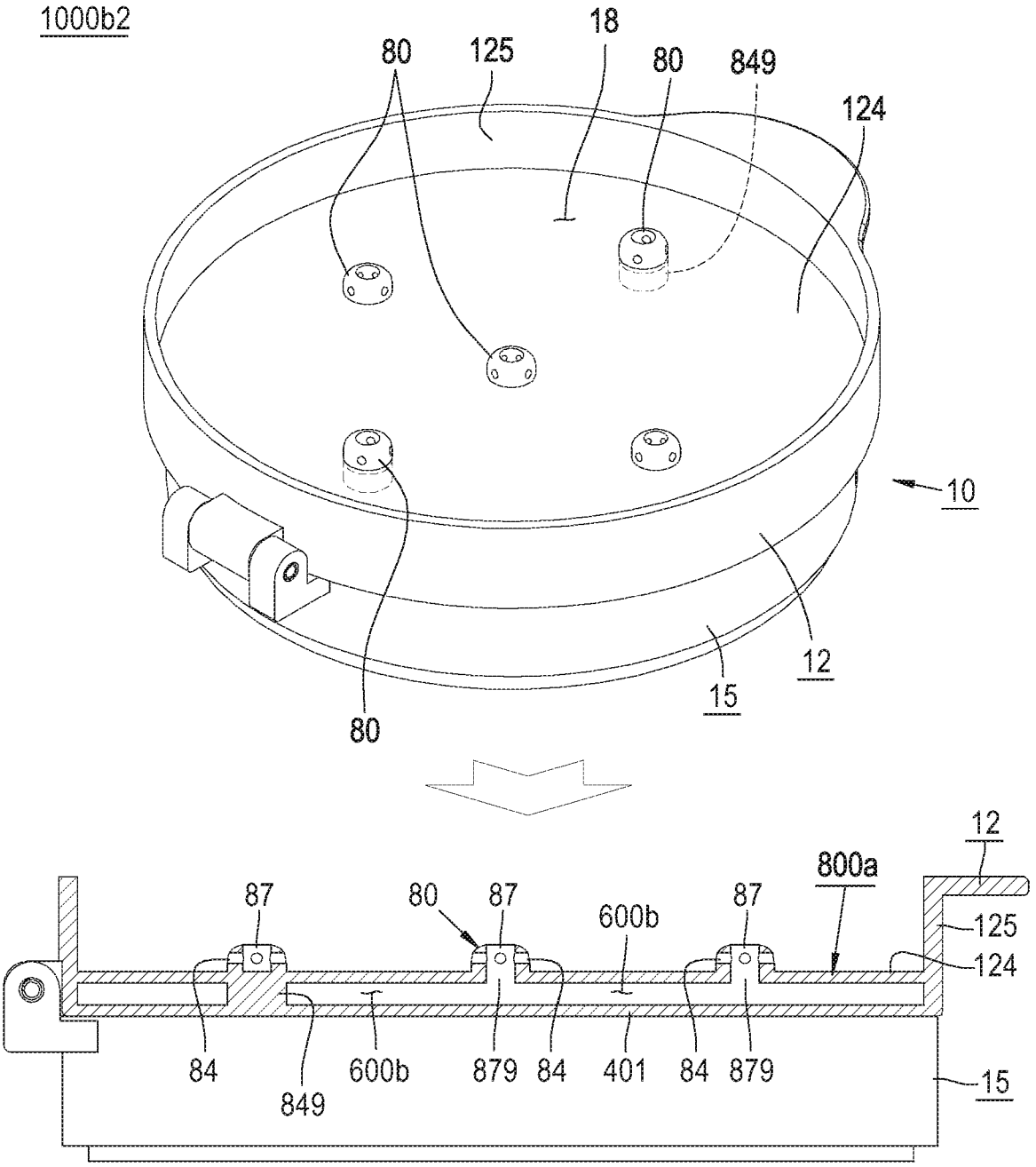

【FIG. 6】
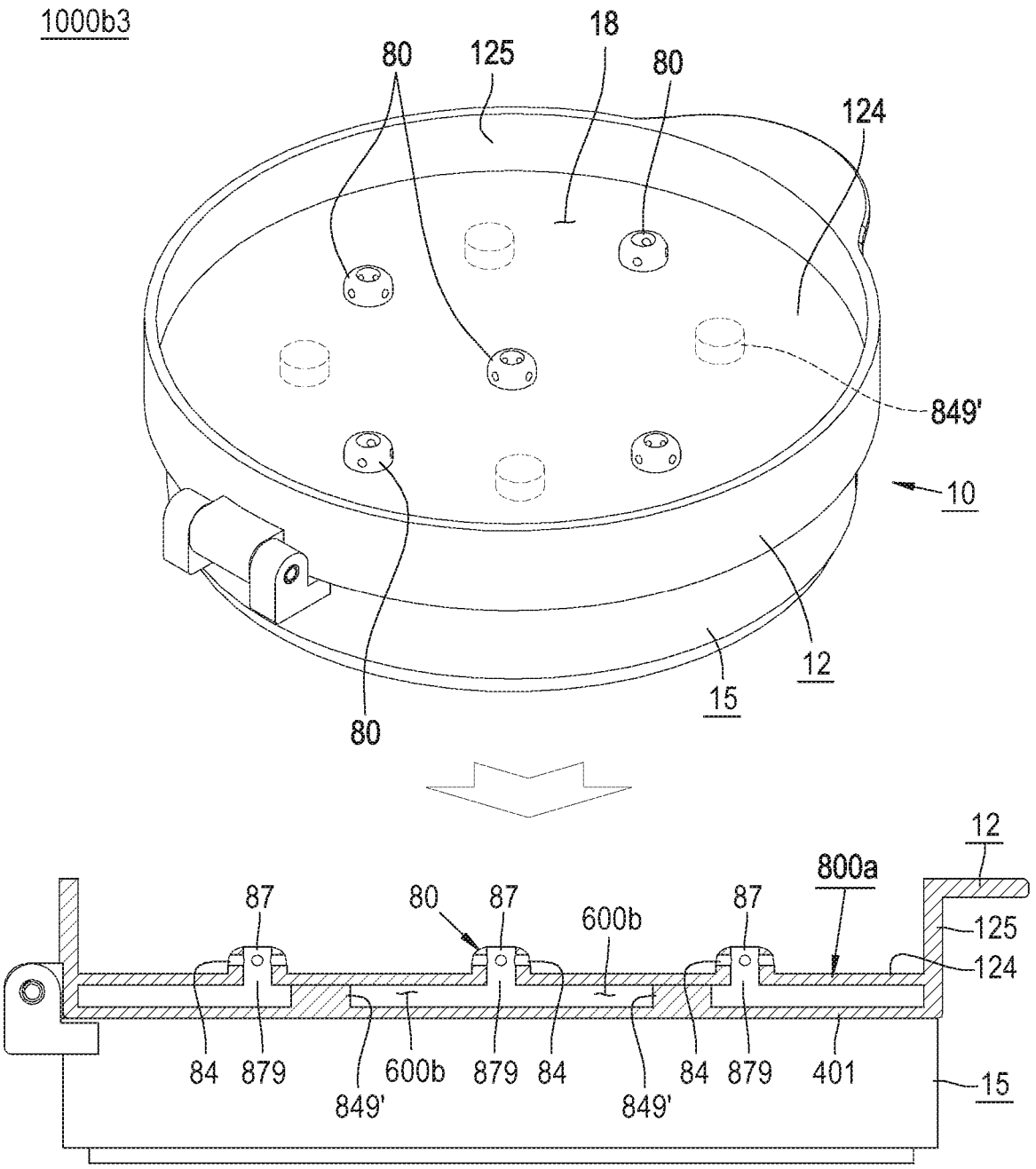

【FIG. 7】
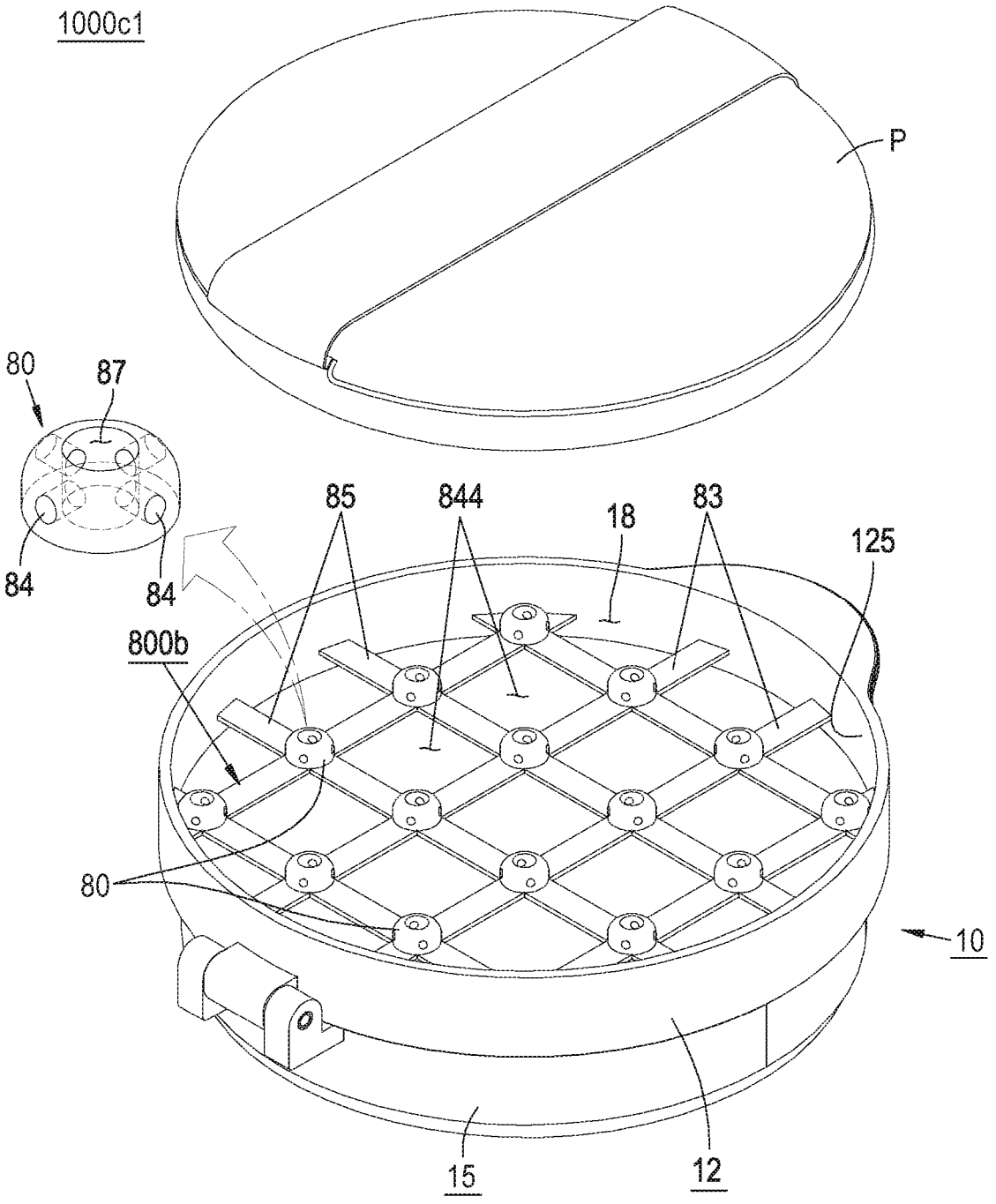

【FIG. 8】
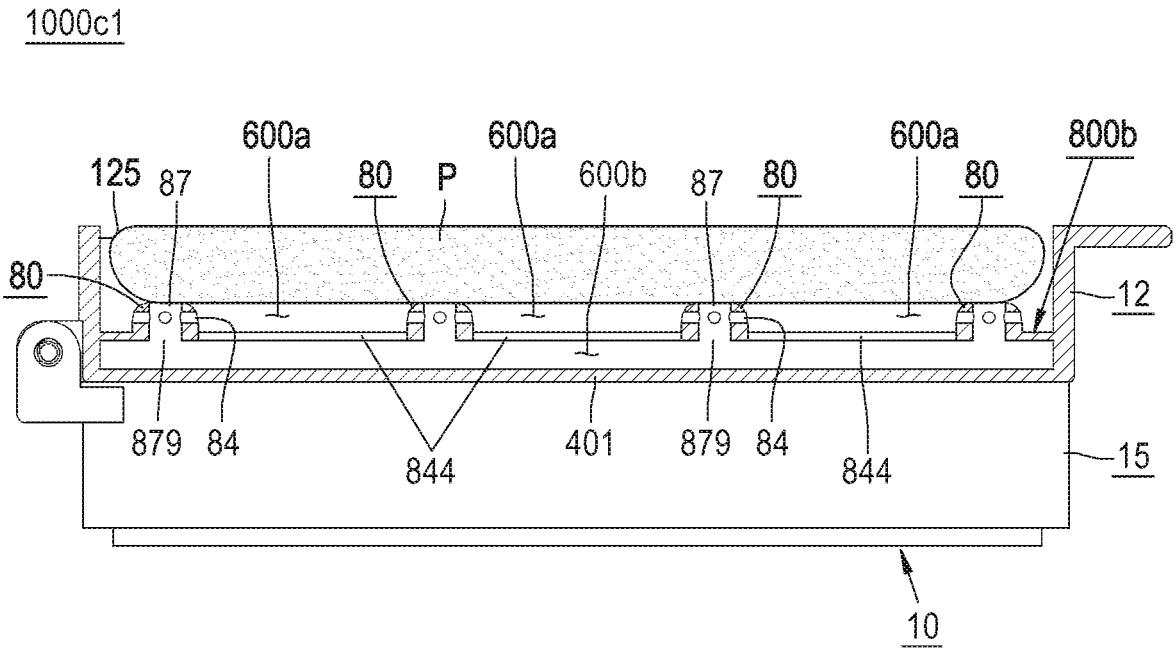

【FIG. 9】
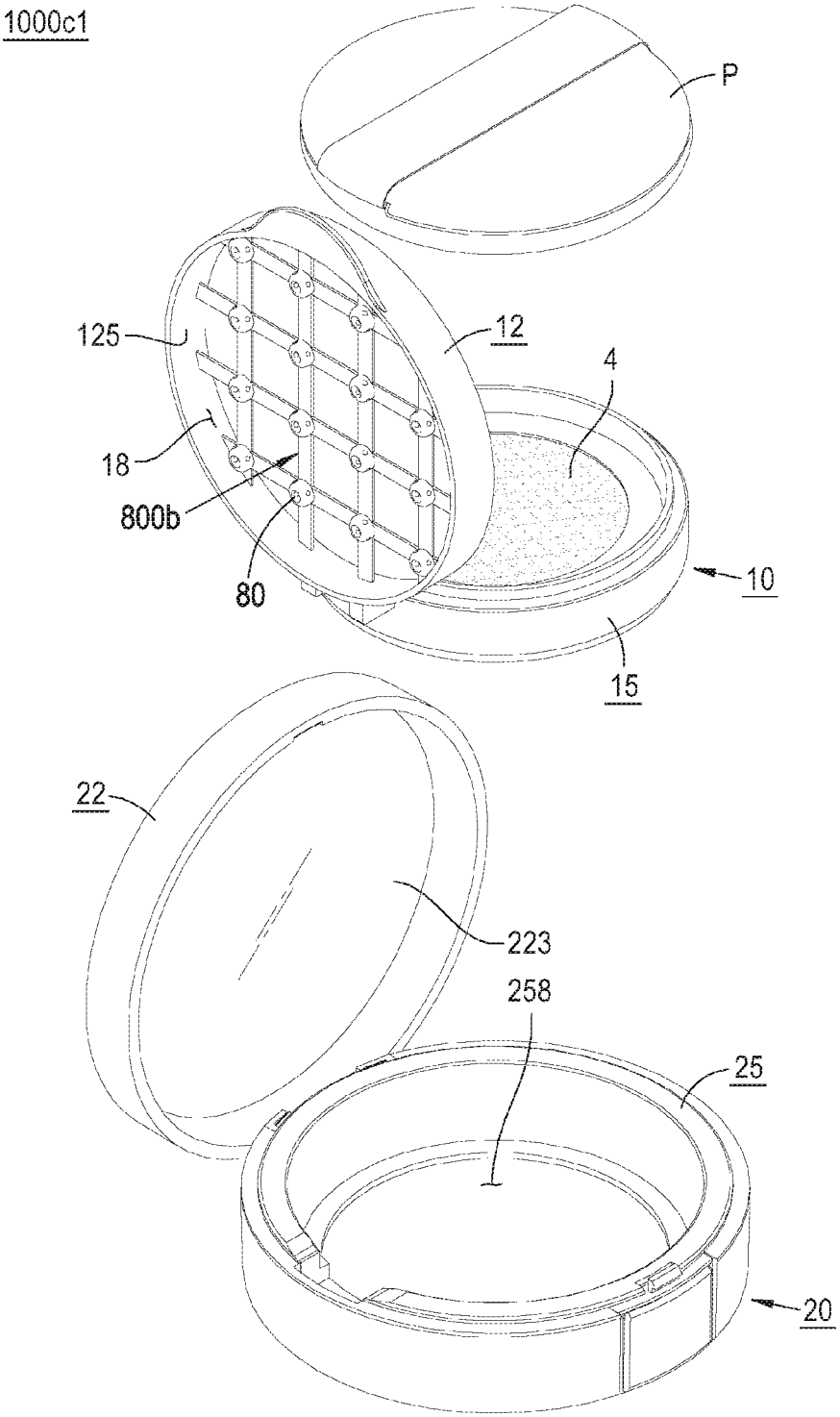

【FIG. 10】
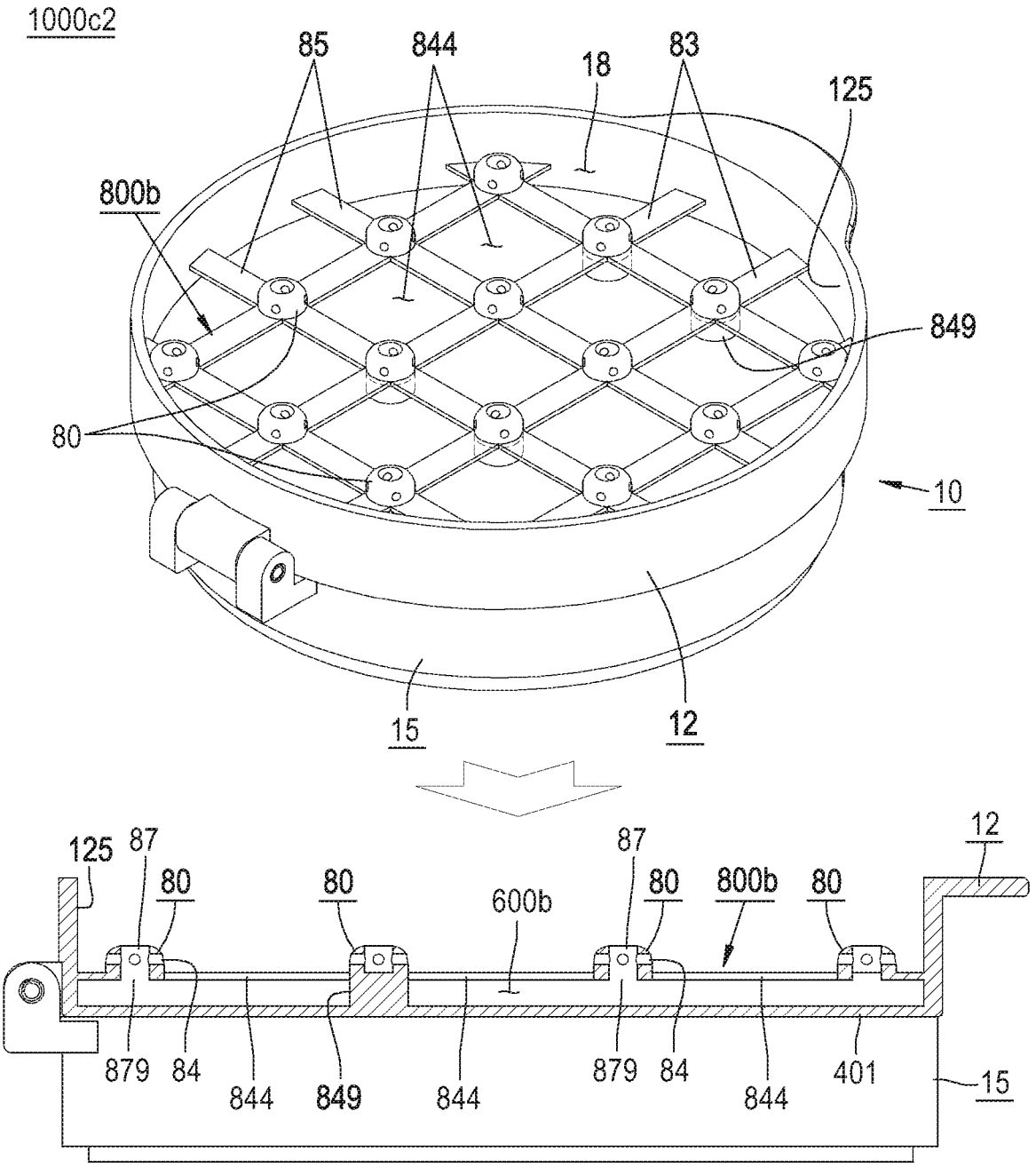

【FIG. 11】
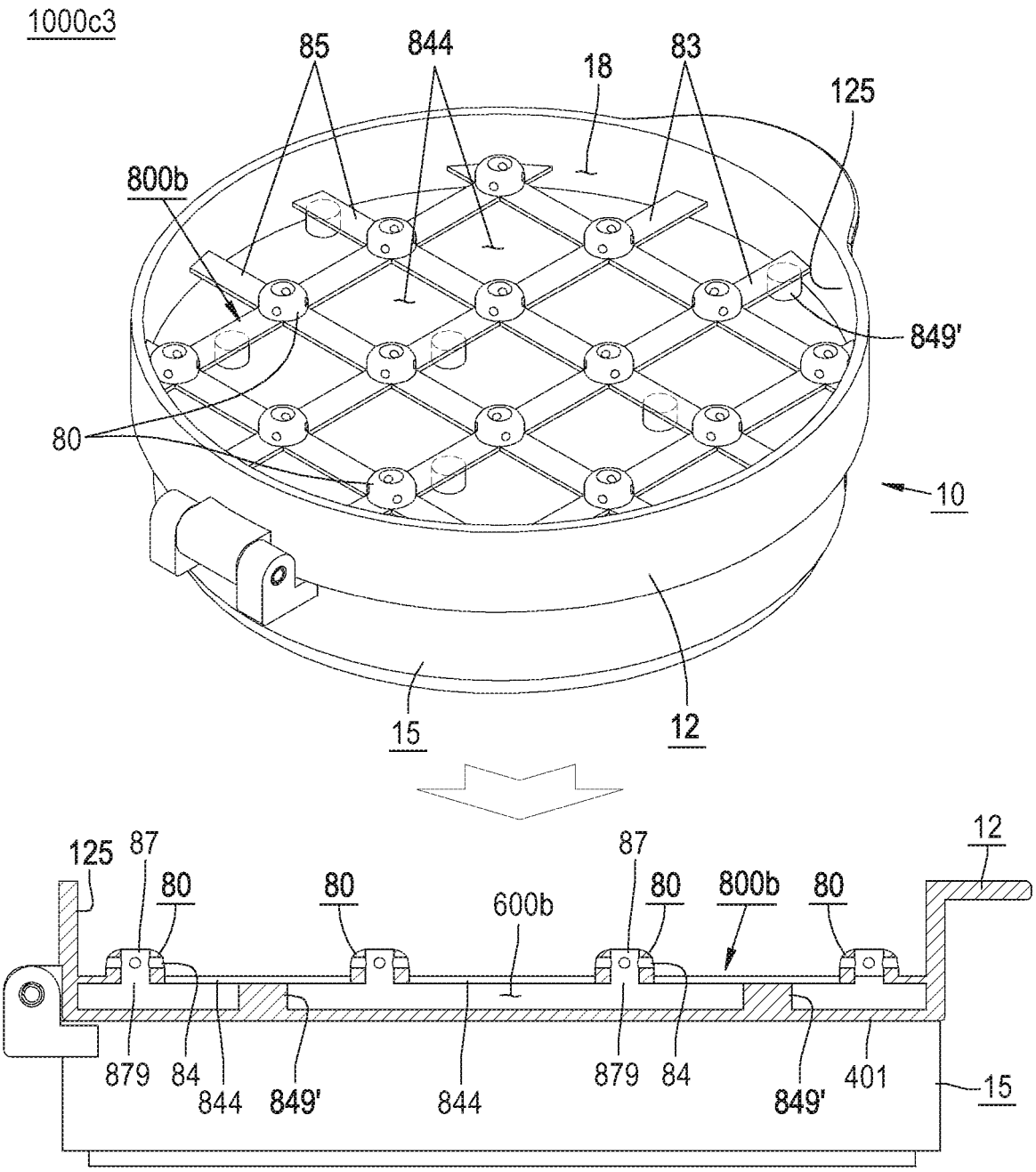

COSMETIC CONTAINER IN WHICH APPLICATION MEANS HAVING AIR STORAGE SPACE IS EMBEDDED

The present application is a U.S. national phase application under 35 U.S.C. § 371 of International Application No. PCT/KR2020/007668 filed on Jun. 12, 2020, which claims the benefit of Korean Patent Applications Nos. 10-2019-0071566 filed on Jun. 17, 2019, 10-2020-0028122 filed on Mar. 6, 2020, and 10-2020-0065174 filed on May 29, 2020 in the Korean Intellectual Property Office, the entire disclosure of each of which is incorporated herein by reference.

TECHNICAL FIELD

The present disclosure relates to a cosmetic container including an application member therein, and more particularly, to a cosmetic container including therein an application member such as a puff, and an air storage space by which the application member is easily dried and such dried condition of the application member is maintained.

BACKGROUND

In the present disclosure, a cosmetic container refers to a container for containing contents of cosmetic products, such as a cushion, a foundation, a makeup base, etc., and the cosmetic container according to the present disclosure may include an independent space to accommodate an application member provided separately from a space for containing the contents of cosmetic products.

A puff may be the most representative application member; however, other than the puff, a sponge, etc. may be used as an application member.

By using such application member, users may apply the contents of cosmetic products, such as a cushion, a foundation, a makeup base, etc. to their skin.

FIG. 1 illustrates an example of a cosmetic container 100 for containing contents of cosmetic products, wherein an application member is accommodated in an independent space provided separately from a space containing the contents of cosmetic products.

The cosmetic container 100 may include a container 10 and an external container 20, and more specifically, the container 10 may be a container for containing the contents of cosmetic products 4, and the external container 20 may be a container on which the container 10 is mounted.

As shown in the drawings, the container 10 may include a containing portion 15 containing the contents of cosmetic products 4 and a lid 12 covering the containing portion 15.

A puff accommodating portion 18 to accommodate a puff P may be formed at an upper portion of the lid 12, and accordingly, the lid 12 may not only function as a lid but also accommodate a puff, i.e., a lid 12 also functioning as a house for the puff.

An extending portion 125 extending upwards from a bottom surface 124 of the lid 12 may be formed, and an inside of the extending portion 125 may form the puff accommodating portion 18 in which the puff P is accommodated.

The external container 20 may include an internal container mounting portion 25 on which the container 10 is mounted.

In an example of conventional cosmetic container 100 in the drawings, the internal container mounting portion 25 has a through hole 258, which has a flat cylindrical shape and is wide, and the container 10 is inserted into and mounted in the through hole 258.

The external container 20 may include an external lid 22 coupled with the internal container mounting portion 25, and when the container 10 is inserted into and mounted on the through hole 258 of the internal container mounting portion 25, the external lid 22 may cover the lid 12 of the container 10.

Also, in many cases, a mirror 223 may be provided at inner surface of the external lid 22.

In such a conventional cosmetic container 100, the container 10 may have the lid 12, and the puff accommodating portion 18 on which the puff P is placed and accommodated may be provided at the lid 12; however, in such a structure, the air flow around the application member, such as the puff P may be poor, which may lead to a difficulty in drying the puff P.

That is, when applying the cosmetic products 4, such as foundation, makeup base, etc. to a face with the puff P, skin moisture or oil may be absorbed into the puff P, and the puff P with absorbed skin moisture and oil may be kept on the bottom surface 124 of the lid 12 and may remain wet.

For this reason, a user may sometimes wash and dry the puff P before putting the puff P back in the cosmetic container 100 for next use, or throw away the wet puff P and buy a new puff P to be kept in the cosmetic container 100 for next use.

As such, in a cosmetic container including therein an application member such as a puff, it is desirable that the application member is easily dried and remains dry, and according to the cosmetic container of the present disclosure, an air storage space may be formed when the application member such as a puff is accommodated, which may lead to an efficient contact between the air in the air storage space and the application member such as a puff, and further to facilitated drying of the application member.

As a result of searches conducted by the inventor, Korean Patent No. 10-1385339-0000 entitled "vessel of cosmetics" has been found as an invention having a similar technical goal as the present disclosure.

DETAILED DESCRIPTION

Technical Goal of the Invention

The present disclosure aims to provide a cosmetic container including therein an application member such as a puff, in which an air storage space is formed when the application member is accommodated to facilitate efficient contact between the air in the air storage space and the application member, so that the application member is easily dried and the dried condition of the application member is maintained.

Means for Achieving Technical Goal

The present disclosure relates to a cosmetic container comprising

- a container including:
  - a containing portion for containing contents of cosmetic products; and
  - a lid functioning not only as a lid for the containing portion but also as a house for an application member, which includes an application member accommodating portion where an application member is accommodated, and a blocked bottom plate, wherein a plurality of protrusions protruding upwards are provided at the application member accommodating portion of the lid, the application member is arranged to be in contact with an upper surface of the protrusions in the application member accommodating portion, and a first air storage portion is formed between the application member and a bottom surface of the lid.

According to the present disclosure, an upper portion of the protrusions may have an open vertical hole, through which portions of the application member placed at the upper surface of the protrusions, the portions in contact with the vertical hole are in contact with the air, thereby facilitating the drying of the application member.

In this case, a transverse through hole intersecting with the vertical hole may be formed at the protrusions.

According to the present disclosure, the protrusions may be formed at an upper surface of the bottom plate of the lid.

According to the present disclosure, in the application member accommodating portion of the lid, an intermediate member having a plate shape may be horizontally arranged at a position upward apart from the bottom plate of the lid, the protrusions may be provided at an upper surface of the plate-shaped intermediate member, and the vertical hole of the protrusions may pass through the plate-shaped intermediate member and communicate with a second air storage portion formed between the plate-shaped intermediate member and the bottom plate of the lid.

In this case, a supporting pillar to support the plate-shaped intermediate member may be provided between the plate-shaped intermediate member and the upper surface of the bottom plate of the application member accommodating portion of the lid.

In addition, according to the present disclosure, a through space portion may be formed at various parts of the plate-shaped intermediate member. Similar to the above, a supporting pillar to support the plate-shaped intermediate member may be provided between the plate-shaped intermediate member and the upper surface of the bottom plate of the application member accommodating portion of the lid.

According to the present disclosure, the cosmetic container may further include an external container including a container mounting portion on which the container is mounted, and a lid to cover the lid including the application member accommodating portion when the container is mounted on the container mounting portion.

Effect of the Invention

According to the first aspect of the present disclosure, by forming a first air storage portion between a bottom surface of the lid and the puff, a bottom surface of the puff may be in contact with the air and drying of the puff may be facilitated.

In a case where a vertical hole is formed at the protrusion, a portion of the puff in contact with the protrusion may also be in contact with the air through the vertical hole and the drying of the puff may be facilitated.

Furthermore, when a transverse through hole intersecting with the vertical hole is formed at the protrusion, the air passing through the transverse through hole may flow through the vertical hole to a portion at which the puff is in contact with the protrusion, and the drying of the portion of the puff in contact with the vertical hole may be further facilitated.

According to the second aspect of the present disclosure, in addition to the effect according to the first aspect, the air stored in the second air storage portion may flow through the vertical hole to a portion of the puff placed on the upper surface of the protrusion in contact with the vertical hole, and drying of the portion may be sufficiently facilitated.

In addition, when the protrusion has a transverse through hole, the air of the second air storage portion may flow through the transverse through hole to the first air storage portion to enrich the air of the first air storage portion and facilitate the drying of the bottom surface of the puff in contact with the portion.

According to the third aspect of the present disclosure, in addition to the effects according to the first and second aspects, air from the second air storage portion may flow through the through space portion of the plate-shaped intermediate member, and then through the first air storage portion to be in contact with the bottom surface of the puff on the upper surface of the protrusion, and the drying of the puff may be further facilitated. That is, compared to the case according to the second aspect, due to the through space portion of the plate-shaped intermediate portion, the air of the second air storage portion may be in contact with a greater area of the bottom surface of the puff, and accordingly, the puff may be easily dried.

BRIEF DESCRIPTION OF THE DRAWINGS

FIG. 1 is a diagram illustrating a structure of a conventional cosmetic container having a container and an external container.

FIGS. 2 and 3 are diagrams illustrating a structure of a cosmetic container according to the first aspect of the present disclosure.

FIGS. 4 to 6 are diagrams illustrating a structure of a cosmetic container according to the second aspect of the present disclosure.

FIGS. 7 to 11 are diagrams illustrating a structure of a cosmetic container according to the third aspect of the present disclosure.

DESCRIPTION OF EMBODIMENT

Preferred embodiments of the present disclosure are now described in detail with reference to the accompanying drawings.

First, in the embodiments below, the puff P is described as an application member for applying contents of cosmetic products such as a cushion, foundation, makeup base, etc. contained in a cosmetic container to the skin; however, the present disclosure is not limited thereto. That is, the representative application member of the present disclosure is a puff P but the present disclosure is not limited thereto, and the application member may also include other thin plate-shaped member, for example, a sponge, etc.

Meanwhile, although the following embodiments and the drawings mainly describe the container 10 having the containing portion 15 and the lid 12, the container 10 and the external container 20 are coupled with each other to form a cosmetic container as a whole.

The container 10 does not necessarily need to be coupled with the external container 20 of the embodiment, and may be combined with other cosmetic containers of different structures as a container.

The reference numerals 1000*a* and the like in the embodiments below denote cosmetic containers as a whole into which the container 10 and the external container 20 are combined.

The structure of a cosmetic container 1000*a* according to the first aspect of the present disclosure is described with reference to FIGS. 2 and 3.

As shown in the drawings, the container 10 of the cosmetic container 1000*a* may include a containing portion 15 in which contents of cosmetic products is contained, and a lid 12, which is a lid of the containing portion 15.

The lid 12 may include an application member accommodating portion 18 in which an application member is accommodated, and a blocked bottom plate 401, and accordingly, the containing portion 15 and the lid 12 may be blocked by the bottom plate 401.

According to the present disclosure, a plurality of protrusions 80 protruding upward may be provided at the application member accommodating portion 18 in the lid 12 of the container 10.

In the case of this embodiment, the protrusions 80 may be provided at the upper surface of the bottom plate 401 of the lid 12 and the bottom surface 124 of the lid 12.

Accordingly, when the puff P is placed on the upper surface of the protrusions 80, an air storage portion 600*a* for storing air may be formed between the bottom surface of the puff P and the bottom surface 124 (see FIG. 3).

Accordingly, the bottom surface of the puff P may be in contact with the air of the air storage portion 600*a* and the drying may be facilitated.

In particular, according to the present disclosure, an open vertical hole 87 may be provided at an upper portion of the protrusion 80.

Then, a portion of the puff P placed on the upper surface of the protrusion 80 in contact with the vertical hole 87 may also be in contact with the air, thereby facilitating the drying.

Further, a transverse through hole 84 intersecting with the vertical hole 84 may be formed at the protrusions 80.

In this case, the air passing through the transverse through hole 84 may flow through the vertical hole 87 to the portion of the puff P in contact with the protrusion 80, and drying of the portion of the puff P in contact with the vertical hole 87 may be facilitated.

FIGS. 4 to 6 illustrate structures of cosmetic containers 1000*b*1, 1000*b*2, and 1000*b*3 according to the second aspect of the present disclosure.

In comparison with the cosmetic container 1000*a* according to the first aspect of the present disclosure, as for the cosmetic containers according to the second aspect of the present disclosure, at the application member accommodating portion 18 of the lid 12, a plate-shaped intermediate member 800*a* may be provided at a position upward apart from the bottom plate 401 of the lid 12, and the plurality of protrusions 80 may be provided at the upper surface of the plate-shaped intermediate member 800*a*.

In addition, the vertical hole 87 of the protrusion 80 may penetrate the plate-shaped intermediate member 800*a*. Accordingly, in the drawings, a through hole 879 penetrating the plate-shaped intermediate member 800*a* is described at the lower portion of the vertical hole 87.

According to the second aspect of the present disclosure, a second air storage portion 600*b* may be formed between the plate-shaped intermediate member 800*a* and the bottom plate 401 of the lid 12, and the vertical hole 87 of the protrusion 80 may communicate with the second air storage portion 600*b*.

The protrusion 80 may have only the vertical hole 87, or may have the transverse through hole 84 along with the vertical hole 87 as shown in the drawings.

According to the second aspect of the present disclosure, the second air storage portion 600*b* may store the air, and the stored air of the second air storage portion 600*b* may flow through the vertical hole 87 to the portions of the puff P placed on the upper surface of the protrusion 80 in contact with the vertical hole 87, thereby drying such portions.

In this case, due to the second air storage portion 600*b*, more air may be provided compared to the case according to the first aspect, and accordingly, the drying may be performed more efficiently.

Meanwhile, when the protrusion 80 has the transverse through hole 84, the air of the second air storage portion 600*b* may flow through the transverse through hole 84 to the first air storage portion 600*a* to enrich the air of the first air storage portion 600*a* and facilitate the drying of the bottom surface of the puff P in contact with the portion.

Further, as in the case according to the first aspect, the air passing through the transverse through hole 84 may flow through the vertical hole 87 to the portion of the puff P in contact with the protrusion 80, and the portion of the puff P in contact with the vertical hole 87 may also be in contact with the air, which leads to facilitated drying of the portion.

According to the second aspect of the present disclosure, between the plate-shaped intermediate member 800*a* and the bottom plate 401 of the application member accommodating portion 18 of the lid 12, supporting pillars 849 and 849' to support the plate-shaped intermediate member 800*a* may be provided.

In the case of the cosmetic container 1000*b*2 of FIG. 5, the supporting pillars 849 may extend downward from some of the protrusions 80.

In the case of the cosmetic container 1000*b*3 of FIG. 6, independent supporting pillars 849' may be provided irrelevant to the protrusions 80.

The supporting pillars 849 and 849' may be arranged to prevent the plate-shaped intermediate member 800*a* from being bent downward, and in addition to this, the lid 12 may be lifted together with the plate-shaped intermediate member 800*a* at which the protrusions 80 are provided by the supporting pillars 849 and 849'. That is, the supporting pillars 849 and 849' may be provided to make sure that the lifting is made stably in response to the pulling force applied in the vertical direction with respect to the protrusions 80.

Meanwhile, according to the present disclosure, the plate-shaped intermediate member 800*a* at which the protrusions 80 are provided may be arranged separately from the lid 12, and may be assembled with the application member accommodating portion 18 of the lid 12.

The protrusions 80 may also be separately manufactured and assembled with the plate-shaped intermediate member 800*a*.

FIGS. 7 to 11 illustrate structures of cosmetic containers 1000*c*1, 1000*c*2, and 1000*c*3 according to the third aspect of the present disclosure.

In comparison with the cosmetic containers according to the second aspect of the present disclosure, as for the cosmetic containers according to the third aspect, a through space portion 844 may be formed at various parts of the plate-shaped intermediate member 800*b*.

That is, the through space portion 844 may be formed at various parts of the plate-shaped intermediate member 800*b* arranged at a positon upward apart from the bottom plate 401 of the lid 12.

FIGS. 7 and 8 show an example of such structure. The plate-shaped intermediate member 800*b* may include a plurality of strip members 83 and 85 intersecting each other, and through spaces between the strip members 83 and 85 may form the through space portion 844. The through space portion 844 may include a lateral wall 125 of the puff accommodating portion 18 of the lid 12 and spaces formed between the strip members 83 and 85.

FIG. 9 shows that the container 10 is mounted on the external container 20 to form the cosmetic container 1000*c*1 as a whole, which has already been described above with reference to FIG. 1.

According to the third aspect of the present disclosure, when the puff P is placed on the upper surface of the plate-shaped intermediate member 800*b*, as shown in the drawings, the first air storage portion 600*a* may be formed between the puff P and the plate-shaped intermediate member 800*b*, and the second air storage portion 600*b* may be formed between the plate-shaped intermediate member 800*b* and the bottom plate 401.

In this case, the air of the second air storage portion 600*b*, along with the air of the first air storage portion 600*a*, may pass through the through space portion 844 of the plate-shaped intermediate member 800*b* to be in contact with the bottom surface of the puff P, and accordingly, drying of the bottom surface of the puff P in contact with the air may be further facilitated.

That is, compared to the case according to the second aspect, due to the through space portion 844 of the plate-shaped intermediate portion 800*b*, the air of the second air storage portion 600*b* may be in contact with a greater area of the bottom surface of the puff P.

The vertical hole 87 of the protrusion 80 may penetrate the plate-shaped intermediate member 800*b* and communicate with the second air storage portion 600*b* so that portions of the puff P in contact with the protrusions 80 may also be dried.

As in the cosmetic containers according to the first and second aspects of the present disclosure, the protrusions 80 may have a transverse through hole intersecting with the vertical hole 87.

Then, as in the case according to the first aspect, the air passing through the transverse through hole 84 may flow through the vertical hole 87 to the portion of the puff P in contact with the protrusion 80, and the portion of the puff P in contact with the vertical hole 87 may also be in contact with the air, which leads to facilitated drying of the portion.

In addition, as in the case according to the second aspect of the present disclosure, the air of the second air storage portion 600*b* may flow through the transverse through hole 84 to the first air storage portion 600*a* to enrich the air of the first air storage portion 600*a* and facilitate the drying of the bottom surface of the puff P in contact with the portion.

According to the third aspect of the present disclosure, between the plate-shaped intermediate member 800*b* and the bottom plate 401 of the application member accommodating portion 18 of the lid 12, supporting pillars 849 and 849' to support the plate-shaped intermediate member 800*b* may be provided.

In the case of the cosmetic container 1000*c*2 of FIG. 10, the supporting pillars 849 may extend downward from some of the protrusions 80.

In the case of the cosmetic container 1000*c*3 of FIG. 11, independent supporting pillars 849' may be provided irrelevant to the protrusions 80.

These cases are the same as the case described above according to the second aspect of the present disclosure, and thus, detailed descriptions thereon are omitted.

According to the first aspect of the present disclosure, by forming the first air storage portion 600*a* between the bottom surface 124 of the lid 12 and the puff, the bottom surface of the puff P may be in contact with the air and drying of the puff may be facilitated.

In a case where the vertical hole 87 is formed at the protrusion 80, a portion of the puff P in contact with the protrusion 80 may also be in contact with the air through the vertical hole 87 and the drying of the puff may be facilitated.

Furthermore, when the transverse through hole 84 intersecting with the vertical hole 87 is formed at the protrusion 80, the air passing through the transverse through hole 84 may flow through the vertical hole 87 to the portion where the puff P is in contact with the protrusion 80, and drying of the portion of the puff P in contact with the vertical hole 87 may be facilitated.

According to the second aspect of the present disclosure, in addition to the effect according to the first aspect, the air stored in the second air storage portion 600*b* may flow through the vertical hole 87 communicating with the second air storage portion 600*b* to the portion of the puff P placed on the upper surface of the protrusion 80 in contact with the vertical hole 87, and drying of the portion may be even more facilitated.

In addition, when the protrusion 80 has the transverse through hole 84, the air of the second air storage portion 600*b* may flow through the transverse through hole 84 to the first air storage portion 600*a* to enrich the air of the first air storage portion 600*a* and facilitate the drying of the bottom surface of the puff P in contact with the portion.

According to the third aspect of the present disclosure, in addition to the effects according to the first and second aspects, air from the second air storage portion 600*b* may flow through the through space portion 844 of the plate-shaped intermediate member 800*b*, and then through the first air storage portion 600*a* to be in contact with the bottom surface of the puff P placed on the upper surface of the protrusions 80, and the drying of the puff P may be further facilitated.

That is, compared to the case according to the second aspect, due to the through space portion 844 of the plate-shaped intermediate portion 800*b*, the air of the second air storage portion 600*b* may be in contact with a greater area of the bottom surface of the puff P and accordingly, the drying may be further facilitated.

The invention claimed is:

1. A cosmetic container comprising a container including:

a containing portion configured to contain contents of cosmetic products; and a lid configured to function both as a lid for the containing portion and as a house for an application member, which includes an application member accommodating portion where the application member is accommodated, and a blocked bottom plate, wherein a plurality of protrusions protruding upwards are provided at the application member accommodating portion of the lid, wherein the application member is placed to be in contact with an upper surface of the protrusions in the application member accommodating portion, wherein a first air storage portion is formed between the application member and a bottom surface of the lid, and wherein an upper portion of the protrusions has an open vertical hole, by which portions of the application member placed at the upper surface of the protrusions in contact with the open vertical hole are in contact with air to facilitate drying of the application member.

2. The cosmetic container of claim 1, wherein a transverse through hole intersecting with the open vertical hole is formed at the protrusions.

3. The cosmetic container of claim 1, wherein the protrusions are formed at an upper surface of the bottom plate of the lid.

4. The cosmetic container of claim 1, wherein in the application member accommodating portion of the lid, an intermediate member having a plate shape is horizontally arranged at a position upward apart from the bottom plate of the lid, wherein the protrusions are provided at an upper surface of the intermediate member, and wherein the open vertical hole of the protrusions passes through the intermediate member and communicates with a second air storage portion formed between the intermediate member and the bottom plate of the lid.

5. The cosmetic container of claim 4, wherein supporting pillars to support the intermediate member are provided between the intermediate member and an upper surface of the bottom plate of the application member accommodating portion of the lid.

6. The cosmetic container of claim 4, wherein a through space portion is provided at various parts of the intermediate member.

7. The cosmetic container of claim 6, wherein supporting pillars to support the intermediate member are provided between the intermediate member and an upper surface of the bottom plate of the application member accommodating portion of the lid.

8. The cosmetic container of claim 1, further comprising an external container including a container mounting portion on which the container is mounted and a lid to cover the lid including the application member accommodating portion when the container is mounted on the container mounting portion.

* * * * *